US007962929B1

(12) United States Patent
Oddo et al.

(10) Patent No.: US 7,962,929 B1
(45) Date of Patent: Jun. 14, 2011

(54) USING RELEVANCE TO PARSE CLICKSTREAMS AND MAKE RECOMMENDATIONS

(75) Inventors: Anthony Scott Oddo, Hyde Park, MA (US); Devin F. Hosea, Princeton, NJ (US)

(73) Assignee: Comcast IP Holdings I, LLC, Philadelphia, PA (US)

( * ) Notice: Subject to any disclaimer, the term of this patent is extended or adjusted under 35 U.S.C. 154(b) by 1314 days.

(21) Appl. No.: 10/677,862

(22) Filed: Oct. 2, 2003

Related U.S. Application Data

(60) Provisional application No. 60/415,740, filed on Oct. 3, 2002.

(51) Int. Cl.
*H04H 60/32* (2008.01)

(52) U.S. Cl. ..... 725/21; 725/13; 725/14

(58) Field of Classification Search ..... 725/46, 725/9, 10, 21
See application file for complete search history.

(56) References Cited

U.S. PATENT DOCUMENTS

| | | | | |
|---|---|---|---|---|
| 5,894,331 | A * | 4/1999 | Yang | 348/730 |
| 6,005,597 | A | 12/1999 | Barrett et al. | |
| 6,163,316 | A | 12/2000 | Killian | |
| 6,177,931 | B1 | 1/2001 | Alexander et al. | |
| 6,248,946 | B1 | 6/2001 | Dwek | |
| 6,332,163 | B1 | 12/2001 | Bowman-Amuah | |
| 6,345,288 | B1 | 2/2002 | Reed et al. | |
| 6,360,275 | B1 | 3/2002 | Chu et al. | |
| 6,507,306 | B1 * | 1/2003 | Griesau et al. | 341/176 |
| 7,096,486 | B1 * | 8/2006 | Ukai et al. | 725/58 |
| 7,103,903 | B1 * | 9/2006 | Kydd | 725/9 |
| 7,212,979 | B1 * | 5/2007 | Matz et al. | 705/1.1 |
| 7,260,823 | B2 * | 8/2007 | Schlack et al. | 725/9 |
| 2002/0174430 | A1 * | 11/2002 | Ellis et al. | 725/46 |
| 2002/0199193 | A1 * | 12/2002 | Gogoi et al. | 725/46 |
| 2002/0199194 | A1 * | 12/2002 | Ali | 725/46 |
| 2003/0037333 | A1 * | 2/2003 | Ghashghai et al. | 725/46 |
| 2003/0067554 | A1 * | 4/2003 | Klarfeld et al. | 348/461 |
| 2003/0084450 | A1 * | 5/2003 | Thurston et al. | 725/46 |
| 2003/0208767 | A1 * | 11/2003 | Williamson et al. | 725/93 |
| 2004/0073918 | A1 * | 4/2004 | Ferman et al. | 725/34 |
| 2008/0040740 | A1 * | 2/2008 | Plotnick et al. | 725/32 |

FOREIGN PATENT DOCUMENTS

| | | |
|---|---|---|
| WO | WO 00/33224 A1 | 6/2000 |
| WO | WO 00/49801 A1 | 8/2000 |

* cited by examiner

*Primary Examiner* — Andrew Y Koenig
*Assistant Examiner* — Junior O Mendoza
(74) *Attorney, Agent, or Firm* — Banner & Witcoff, Ltd.

(57) ABSTRACT

Disclosed are systems and methods for generating viewing recommendations in a television viewing personalization system, including parsing, in accordance with a set of stored processing rules, a stream of command signals generated by a remote control unit in response to control sequences entered into the control unit by a viewer, to generate information representative of the viewer's viewing behavior; and determining, from the generated information, at least one viewing recommendation.

19 Claims, 2 Drawing Sheets

USING RELEVANCE TO PARSE CLICKSTREAMS AND MAKE RECOMMENDATIONS

CROSS-REFERENCE TO RELATED APPLICATION

The present application for patent claims the priority of and incorporates by reference commonly-owned U.S. Provisional Application for Patent Ser. No. 60/415,740 filed Oct. 3, 2002.

INCORPORATION BY REFERENCE

Applicants hereby incorporate by reference the following commonly owned patent applications: PCT/US02/16674 filed May 29, 2002; and 60/359,872 filed Feb. 25, 2002, both entitled User Identification Methods and Systems.

FIELD OF THE INVENTION

The present invention relates to methods, systems and devices for television viewing personalization, including. Electronic Programming Guides (EPGs).

BACKGROUND OF THE INVENTION

There has been a great deal of recent activity aimed at developing applications that personalize an individual's television viewing experience. Many of these applications require explicit input from the user. Such user input may take one or more of a wide range of forms, depending on the purpose of the application. For example, if the application is designed to help the user record their favorite shows, then the input may require the user to navigate through a series of menus, or it may require the press of a single button, such as a "thumbs up" or "RECORD" when the show is on. Requiring the user to provide explicit input is often perceived by the user as being "too much work" for the benefit of personalization. This has led to low adoption of these types of personalization systems.

Conversely, personalization systems that use no explicit user input, and which instead rely solely on implicit data, face a number of difficulties that must be overcome in order for the system to be effective. One such difficulty is determining when the viewer is actually watching television. Another is interpreting remote control button events to determine which programs the viewer likes best.

The nature of the first issue is not as obvious as it might at first appear. The data generated by the viewer's viewing habits will originate from the set top box (STB), and most viewers rarely turn the STB off. In addition, the STB generally has no connection to the TV set that would allow it to determine whether or not the TV is actually on. Accordingly, there currently exists no straightforward way of knowing, based solely on STB status, whether or not the viewer is actively watching TV. Even if viewers always turned off their STBs when they were finished watching television, one still would not be able to reliably conclude that the viewers were watching TV simply because the STB was on. The viewer could be asleep, or they could be out of the room, and there would be no way to tell.

The second issue is closely related to the first in that they both rely on button events. However, whereas the first issue relies on button presses to determine if the viewer is actively watching TV, the second must impose some meaning on the button presses to determine if the viewer is interested in the current program.

SUMMARY OF THE INVENTION

The present invention addresses these issues by providing, in one aspect, a method of generating viewing recommendations in a television viewing personalization system, the method including parsing, in accordance with a set of stored processing rules, a stream of command signals generated by a remote control unit in response to control sequences entered into the control unit by a viewer, to generate information representative of the viewer's viewing behavior; and determining, from the generated information, at least one viewing recommendation.

Another aspect of the invention provides a recommendation generating system for a television viewing personalization system, including a parsing component for parsing, in accordance with a set of stored processing rules, a stream of command signals generated by a control unit in response to control sequences entered into the control unit by a viewer, to generate information representative of the viewer's viewing behavior; and a determining component, in communication with the parsing means, for determining, from the generated information, at least one viewing recommendation.

BRIEF DESCRIPTION OF THE TABLES

Figure 1:
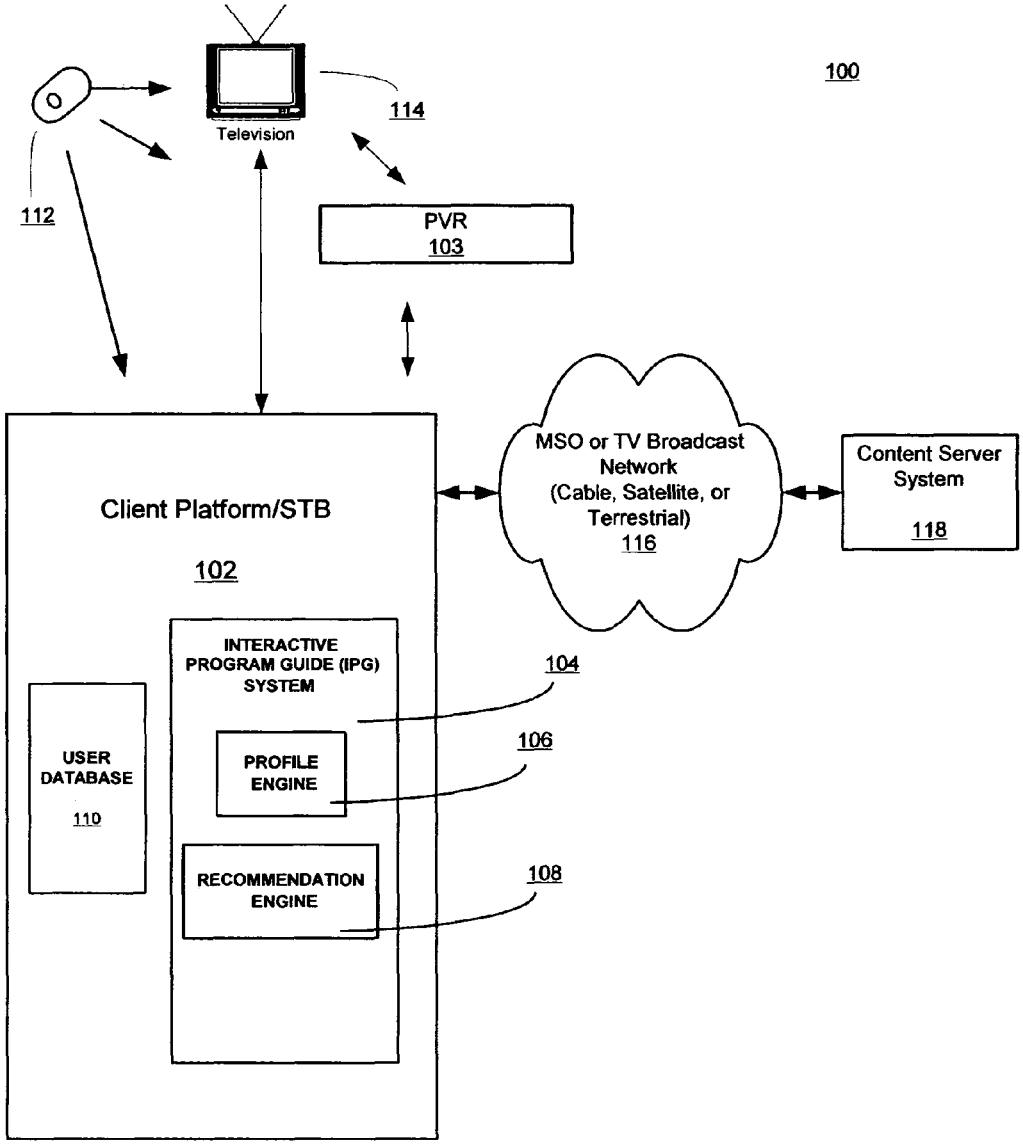
FIG. 1 is a schematic diagram of an exemplary content delivery system in which the present invention can operate.

TABLE 1 shows a log file of the type that might be generated by a commercially available PVR.

TABLE 2 is another example of a log file.

TABLES 3-6 show examples of profile processing in accordance with the invention.

DETAILED DESCRIPTION OF THE INVENTION

The following detailed description is organized into sections, as follows:

I. Overview.

II. Determining Viewing Events.

III. Determining Relevance of Viewing Events.

IV. Algorithms.

V. Conclusion.

I. OVERVIEW

The present invention provides, in one aspect, a method of generating viewing recommendations in a television viewing personalization system, by parsing a stream of command signals generated by a user's remote control. An exemplary system in which the invention can operate is shown in FIG. 1.

Exemplary Content Delivery/Personalization System: Referring to FIG. 1, there is depicted an example of a conventional content delivery/personalization system 100 in which the present invention can operate. The content delivery/personalization system 100 can include, for example (other configurations are also possible) a server system 118 and a network 116 for providing program content to a client platform/STB 102 and associated television 114 and PVR 103. The client platform 102 can include, or be linked in electronic communication with, a display device (such as a television) 114 for viewing program content, a user interaction device (remote control) 112 for selecting and controlling program content, and an interactive or electronic program guide (IPG or EPG) system 104. Within the IPG/EPG system 104 there can be, as shown in FIG. 1, a profile engine 106 and a recommendation engine 108.

In a conventional IPG/EPG system 104 like that shown in FIG. 1, the recommendation engine 108 may generate ratings for each television show or other content available for viewing, using known methods. Examples of such methods are described in the patent documents incorporated herein by reference. In particular, the recommendation engine 108 may use profile information made available by profile engine 106 to generate the ratings or recommendations. A conventional system can make use of these ratings to assist the viewer in finding and displaying programming to viewers, using known user methods and devices to generate an interactive display on television 114, and can also use these ratings and profile information to deliver personalized content. Conventional methods of generating and displaying ratings and recommendations, and delivering personalized content, are well known in the art.

Those skilled in the art will appreciate that in addition to the configuration shown by way of example in FIG. 1, profiles and recommendations can, alternatively, be generated at a central server (such as server 118) and transmitted to the STB via the network 116.

Referring again to FIG. 1, network 116 can comprise a television broadcast network (e.g., digital cable television, direct broadcast satellite, and/or terrestrial transmission networks), and the client platform device 102 can comprise, for example, a known form of consumer television set-top box (STB). The network 116 can also comprise a computer network such as the Internet (particularly the World Wide Web), Intranets, or other networks. (It should be noted that the present invention is not limited to use with television systems, but can be adapted for use in conjunction with any manner of content, or information, distribution systems including the Internet, cable television systems, satellite television distribution systems, terrestrial television transmission systems, and the like.) As also shown in FIG. 1, the server system 118 can comprise, for example, a video server, which sends data to and receives data from a platform device 102 such as a digital STB. A user can operate the STB (such as to change channels or adjust volume) by employing a user interaction device 112, which may be, for example, a remote control device comprised of an infrared remote control having a keypad.

Functional Overview: The present invention views the interactions between a viewer and a television system (via the remote control unit) as a form of communication. In essence, the viewer, through the use of his or her remote control, is attempting to communicate his or her wishes regarding content. The buttons on the remote control unit constitute a limited set of building blocks with which the user can construct command sequences by which to communicate with the rest of the viewing or content delivery system. The key to interpreting this communication is understanding and identifying the context in which the communication takes place.

For example, if the user changes channels, this act itself could have a number of meanings. In one instance, it could mean that the show the user was watching just ended and now the user is seeking something new to watch. It could be that a commercial advertisement is currently being displayed, and the user is changing to the sports channel to check the score of a game. It could be that the user is no longer interested in the current program and would like to find something else to watch. These are a number of common examples; others are possible as well. Thus, the changing of the channel by itself does not offer sufficient information to enable us to infer which meaning we should apply. However, the present invention advantageously exploits the realization that by combining the information of the button press with the context, history, and understanding of the viewer, one can accurately and reliably determine the meaning of the viewer's actions.

The ability to interpret the user's behavior not only leads to better recommendations to the viewer, but it also allows the processing of their clickstream data on the fly, thus reducing the amount of data that needs to be saved to make recommendations. This is an important advantage, given the memory/storage space constraints posed by most of the STBs currently deployed.

II. DETERMINING VIEWING EVENTS

The first part of the problem of determining the relevance of "clicks" or button presses is to know the viewing history of the user. A viewing history can be built up over time by keeping track of which programs the viewer has watched. This sounds simple in theory, but in practice, can be problematic. A central issue, as noted above, is that viewing data is likely to be generated in the STB, and viewers tend to always leave their STBs on.

The information generated at the STB may be in one of many formats, but common to substantially all of them is the following information: timestamp, button event, and channel, if applicable. With this information, program data can be generated by cross-referencing with a TV data source provider such as Tribune Media Services (TMS). Such a lookup may be performed at a server to which the data is uploaded/downloaded, or it may be executed directly at the STB, since the TMS data is typically made available there as part of the Electronic Programming Guide (EPG).

Parsing Principles: The inventive systems and methods described by way of examples in this document utilize several parsing principles that facilitate interpretation of the data. The first is to assume that the user is asleep unless we have evidence to the contrary. Another is that if a button press event occurs, then the viewer is considered to be awake and actively viewing. If the viewer is awake and there are no button press events for a period of time longer than the "Session Timeout" parameter, then it is assumed that the user is asleep. This assumption is made because we want to use the data to make viewing recommendations. By taking an essentially "conservative" approach, we ensure that the only viewing events we record will be events the viewer actually watched. Any alternative assumption would introduce noise into the system in the form of crediting the viewer with watching programs that they did not actually view. This could potentially lead to spurious recommendations, based on programs that the viewers did not actually watch.

These basic principles enable the system described herein to determine what programs have been viewed by the user without mistakenly crediting the user for viewing shows they have not watched. These principles are relatively straightforward for the case where the viewing data is being generated by a conventional STB. However, if the data is originating from a device other than an STB, such as a personal video recorder (PVR), then there may be other issues to resolve prior to applying the noted principles.

PVRs can create problems because at times, the PVR will actively change the channel to record programs without any input from the user. Consider, for example, TABLE 1, which shows a typical log file of the type that might be generated by a commercially available PVR from TiVo, Inc. of Alviso, Calif. As shown in TABLE 1, each entry has a timestamp, an event type, and an event description followed by further information depending on the event type. Note, for example, that the beginning of the file does not necessarily start with a "TVKEY_POWER" event indicating that the user has turned the TV on. Thus, at the beginning of the file, it is unclear whether the TV is on or off. Further complicating matters is the fact that the TiVo device can be programmed to turn the TV on or off, but it does not always work correctly, sometimes causing the log files to have 2 or more successive power events when only one of them actually occurred. In addition, as noted above, user/viewers do not always use the TiVo remote to turn off the TV. For all of these reasons, one practice of the present invention ignores power events and assumes that the user is asleep at the beginning of the log file, until the system encounters evidence to the contrary.

TABLE 1

```
1023360509|Key|TVKEY_NUM2
1023360510|Key|TVKEY_NUM5
1023360511|Key|TVKEY_ENTER
1023360512|WatchTV|live|WFXT|25|SH0000010000|1023359400|1111
1023360522|Key|TVKEY_NUM0
1023360523|Key|TVKEY_NUM6
1023360524|Key|TVKEY_ENTER
1023360525|WatchTV|live|WSBK|6|SH0005260000|1023359400|1124
1023360532|Key|TVKEY_NUM1
1023360532|Key|TVKEY_NUM6
1023360533|Key|TVKEY_ENTER
1023360534|WatchTV|live|LIFE|16|SH0000010000|1023359400|1134
1023360544|Key|TVKEY_SURFUP
1023360546|WatchTV|live|CNN|17|SH0204200000|1023357600|2945
1023360552|Key|TVKEY_SURFUP
1023360553|WatchTV|live|NIK|18|EP2593950046|1023359400|1153
1023360563|Key|TVKEY_NUM7
1023360564|Key|TVKEY_NUM6
1023360565|Key|TVKEY_ENTER
1023360566|WatchTV|live|COMEDY|76|SH0000010000|1023359400|1166
1023360573|Key|TVKEY_POWER
```

The example of TABLE 1 is a simple one, in which the user was merely watching "live" (or real-time) TV. The log files become more difficult to interpret when the TiVo begins recording programs without input from the user. In the example of TABLE 2 below, note how the first five "WatchTV" events each last 1800 seconds (30 minutes) and occur on the same channel. Also note that there are no button events during this time. This indicates that the viewer is not actively watching television. What has happened in this case is that the TiVo and the STB are on, but the TV is off and the last channel the TV was tuned to was |USA|29|. The TiVo begins to record a program on its own at time 1020682799 and changes the channel to |ETV|42|.

This poses the challenge of how to distinguish between the "WatchTV" events in the above example (TABLE 1) that were caused directly by the viewer and the ones in the example below (TABLE 2) that were caused by the PVR.

One approach might be to note that the "WatchTV" event caused by the TiVo was preceded by an "ST" event at 1020682798. However, it is preferably not to be tied to any particular TiVo nomenclature. Instead, it is desirable to use an approach that will operate on any data set and that will not need to be updated every time an STB or PVR company changes the format of their data.

TABLE 2

```
1020666455|Ver|2.5.1-01-1-000
1020668404|WatchTV|live|USA|29|SH0000010000|1020668400|4
1020670204|WatchTV|live|USA|29|SH0000010000|1020670200|4
1020672004|WatchTV|live|USA|29|SH0000010000|1020672000|4
1020673803|WatchTV|live|USA|29|SH0000010000|1020673800|3
```

TABLE 2-continued

```
1020675603|WatchTV|live|USA|29|SH1339430000|1020675600|2
1020682798|ST|ETV|42|SH4971130000|1020682800|9|1|0
1020682799|WatchTV|live|ETV|42|SH0000010000|1020681000|1799
1020682805|WatchTV|live|ETV|42|SH4971130000|1020682800|3
1020684598|ST|ETV|42|SH4971130000|1020684600|9|1|0
1020684599|WatchTV|live|ETV|42|SH4971130000|1020682800|1798
1020684599|STend|ETV|42|SH4971130000|1020682800|9|1|0
```

Accordingly, one practice of the invention utilizes the following approach:

If the first "WatchTV" event is followed within a defined interval of time by a "Key" event (all button presses are designated as "Key" events) then we consider the viewer to be awake and we credit them with watching the program. For the defined interval of time, one practice of the invention utilizes an interval of 10 minutes (designated the SNOOZE_ALARM variable). Thus, from this example, we now have two principles of parsing:

(1) Always assume the user is asleep unless presented with evidence to the contrary.

(2) When the user is asleep, a "WatchTV" event followed by a "Key" event within 10 minutes is considered to be a viewing event and the user state is changed from asleep to awake.

What happens if a user has not been active for a time (no button presses) and a new show comes on? Should we consider the viewer to be watching the new show or not? This is again a question of how long is too long to be inactive. It will be understood that there are periods of time when a user will essentially sit still and watch a show without "clicking around." With a PVR this is less likely, but out of habit, some viewers may still get up during a commercial rather than hitting the pause button. Thus, one practice of the invention uses 30 minutes as the SESSION_TIMEOUT. Other intervals, of course, may also be used.

By way of example, therefore, assume that the user has been active, a new show comes on, and the last button press was twenty minutes ago. For the moment, the system considers the user to be active and viewing the new show. The system stores the start time and program information of the new show, and then calculates the viewing duration for the previous show. At this point, two things can occur:

(1) A "key" event occurs in the next 10 minutes, confirming that the user is active (the 10 minutes plus the 20 minutes since the last key press confirm that user has been active within the last 30 minutes—i.e., within the predetermined SESSION_TIMEOUT); or (2) a "key" event does not occur within the next 10 minutes, meaning that more than 30 minutes have elapsed without a button press, so that the user must be asleep. The system thus changes the user status from awake to asleep, and the start time and program info for any future "WatchTV" event will overwrite the current "WatchTV" event during which the system determined the user to be asleep. When there is finally a "Key" event, the user will be considered to be awake, and if the previous "WatchTV" event was not too far in the past (10 minutes) then the viewer will be credited with having watched that program.

This operation can be summarized within the second principle of parsing: the user is considered to be asleep if there is a continuous period of time greater than the SESSION_TIMEOUT during which there are no button presses. If there was a WatchTV event during this time, the viewer is not credited with watching it unless there is a key press within the time limit defined by the SNOOZE_ALARM variable (Parsing Principle 2).

If the user is asleep and a "Key" event occurs, the user is then likely to be now awake, and the "WatchTV" event should occur within seconds of the "Key" event that caused the channel to change or the TV to turn on. If a "WatchTV" does not have a "Key" event that proceeds it by less than 10 seconds, then the event is considered to be controlled by a TiVo (or other PVR) and not by the viewer, and it is not counted. This is the third principle of parsing: a "WatchTV" event must closely follow a "Key" event if it is caused by the "Key" event. Otherwise, the event is caused by something else and should not be considered unless another Key event occurs shortly thereafter (principle 2).

Also in this practice of the invention, if, during any period of activity, there are three or more WatchTV events in a row within the SESSION_TIMEOUT, the first two are counted but the rest are not. The reasoning behind this rule is that if the first WatchTV event was caused by a key press (i.e. the user is active), then the second one could be caused by a new program starting on the same channel as the first event, but the third is likely to be caused by the TiVo and not the user. That is, there cannot be two consecutive program changes on the same channel without any interactivity on the part of the viewer, or the session timeout rule would be invoked. Thus, three WatchTV events in a row is an indication that the user is asleep and that the TiVo (or other PVR) is controlling the events. This relates to a $4^{th}$ parsing principle in accordance with the invention: There may be two consecutive WatchTV events with the user being awake, but the presence of three or more is an indication that the user is asleep and the TiVo is controlling the events.

The foregoing rules or principles of parsing can be generalized to any STB or PVR-like device that is capable of recording or monitoring viewing behavior. Substantially all of these devices record timestamps and events and distinguish between button events and viewing events. Thus, if we replace the TiVo-related terms "WatchTV" and "Key" in the above list of principles, with the more general terms "Viewing Events" and "Button Events" then we have a set of general principles applicable to all such devices, as follows:

1. Assume the user is asleep until presented with evidence to the contrary
2. When the user is asleep, a program event followed by a button event within the time defined by the SNOOZE_ALARM (10 minutes) is considered a viewing event.
3. If there is a continuous period of time greater than the SESSION_TIMEOUT during which there are no button events then the user is considered to be asleep. If there was a program event during this time, the viewer is not credited with watching it unless there is a key press within the SNOOZE_ALARM time limit (see principle #2).
4. A program event must closely follow a button event (10 seconds or less) if it is to be counted as a viewing event.
5. There may be two program events in a row with the user being awake, but three or more are an indication that the user is asleep.

III. DETERMINING RELEVANCE OF VIEWING EVENTS

Given the foregoing methods and principles for identifying and categorizing viewing events, the following discussion describes methods for determining from that information the relevance of the events to the viewer—for example, determining whether or not the viewer likes a particular show. This is accomplished by combining the viewing events with button presses and user history in the manner described below.

For purposes of the following initial discussion, we limit ourselves to keys that are common to substantially all contemporary TV remote controls: numbers (0-9), channel up, channel down, power, arrow buttons (up, down, left, right), select, volume up, volume down, mute, information, menu/guide.

Each of these buttons has an obvious context associated with it at some high level, but further inspection will indicate that at the level required for interpreting the user's interest there may not be an obvious or unique context associated with the button press alone. For example, at first blush the mute button would seem to imply that the user is not interested in the current program. However it could just as easily be the case that the user is interested in the current program but has been interrupted by something else. By way of example, possible interpretations include the following:

Mute: volume too loud due to commercial.

Mute: volume too loud due to something in the program (musical guest, crowd noise, etc).

Mute: viewing is interrupted by something that requires the auditory attention but not the viewing attention of the viewer. Indicates the viewer is so interested in the program that they will not turn off the TV despite the interruption.

Mute: viewer is not interested in the current program.

One could continue this analysis process to create lists of possible interpretations for various types of button clicks. However, we can also usefully limit the list of all possible interpretations by focusing on whether or not the user likes the program. In particular, we are interested in three possible states that the user may be in at a given time relative to the current program: (1) the user is interested in the current program; (2) the user is interested in current genre (i.e. shows of this type but not this particular show), and (3) the user is not interested in the current program. The following are thus possibilities of interest:

Channel Change: viewer not interested in current program; is looking for new program;

Channel Change: viewer surfing during commercial break; will return to current program;

Channel Change: program has ended, viewer is looking for new program.

There can also be differences in the relevance based on whether the channel change was due to pressing the "channel up/down" button or whether the user entered the channel number directly. This does not affect the relevance for the program that the user is switching from (in either case the user is no longer interested in the program) but it may say something about the program to which the user is going. The following are examples:

Info: user is interested in current program.

Menu arrows: user not interested in current highlighted selection.

Menu+Info or Menu+long pause: user is interested in current program genre.

Menu+Select: user is interested in current program.

Menu off followed by inactivity: there is currently nothing on of interest to the viewer.

Menu off followed by activity: no conclusion unless user went to a show they had just seen on the menu.

Volume Down—same possibilities as Mute.

Volume Up—viewer is interested in current genre.

Volume Up—sound level was too low due to previous use of volume down or mute.

Power On—the viewer is looking for programming, start new viewing session.

Power Off—the viewer is not interested in current program and has ended current viewing session.

How to determine which of these possible interpretations is the correct one? In accordance with one practice of the invention, this is accomplished by combining this information with knowledge of the user's past history and current activity. Consider, for example, a channel change event. If the viewer has watched the current program previously and has a history of flipping between channels, then we can eliminate various possibilities and conclude that the user is surfing during a commercial break and will return to the program. Or at least, we will make no assumption that the user does not like the program until we encounter clear evidence to the contrary.

This example suggests the utility of storing historical data in different ways. The first is a simple viewing history of programs viewed and viewing durations. The second is a surfing history, where surfing is defined as a sequence of several successive viewing events of short duration (<2 minutes). These histories can be saved in any number of ways, from simply storing all the relevant data to using a compressed representation of the history via a grouping algorithm, neural network, Bayesian network, or the like. The choice of representation depends on the amount of space available on the STB as well as privacy issues that might arise from storing the entire viewing history of the users.

In one practice of the invention we ignore potential information from the volume and mute buttons, as these events often have nothing to do with the user's interest in the current program. The other button events listed above (menu, info, and power) are relatively straightforward to interpret, as described below.

IV. ALGORITHMS

This section describes an exemplary implementation, and variations thereof, for taking the viewer's clickstream, interpreting the relevance of the events, and converting them into numbers that reflect the probability of a user liking a particular program, genre, or station.

Surfing History:

It is relatively simple to reliably interpret the user's intent when they watch a program for long periods of time. In general, it is safe to conclude that the viewer likes the program. The challenge arises in deciding how to interpret viewing events of short durations. One might first assume that viewing a show for only 2 minutes means the viewer does not like the program. However, if the viewer does so repeatedly, it may mean something else. This is particularly true for content such as news, weather, and sports. Empirical observation indicates that it is not uncommon, during commercials or "slow" portions of a sports event of other program, for viewers to "click over" to check the score of a game they are interested in, or to check the weather. In these cases, the short viewing event may be viewed as a positive.

For this reason, it is useful to keep track of the viewer's surfing history. This can be done in many ways, but a particularly useful implementation strives to do so in a manner that requires minimal storage of data, given the memory constraints of a typical STB. Therefore, by way of example, in one practice of the invention, the surfing history consists of the top ten surfing channels (i.e. any station viewed for less than 2 minutes). To generate this list, the system keeps track of any channel visited for less than 2 minutes up to the first 30 channels. The system then sums the duration viewed for each channel. Normally, the frequency of visits to a channel would be a useful metric, in addition to duration; however, since our example indicates that all of the durations involved are very short, the total duration correlates very highly with frequency. Thus, only one such metric is required, and we opt to use total duration. In accordance with this practice of the invention, every few weeks (or at some other interval) the system clears out the channels whose total duration is below the threshold. This enables new channels to bubble up into the surfing history as the user's viewing habits change.

Viewing History:

In addition to surfing history, in one practice of the invention the system also stores a history of all other viewing events. There are many ways of taking the viewing events of the user and distilling them down to a compressed representation of viewing history. Some of these methods require saving the data for long periods of time. For reasons of privacy and because storage space is limited on current STBs, it is advantageous to employ a method that analyzes the data, updates the user profile, and then discards the data. In the future, STBs are likely to have more memory, and PVRs may be more prevalent, such that data saving techniques will be more practicable.

Another point of variation is determining what information belongs in the profile. Many approaches involve saving information about each program, so that the user profile would substantially consist of every program the user has watched, along with a description of the show and how much time and how often the user watched it. While the present invention accommodates such an approach, it can also be useful, in one practice of the invention, to use genre, station, and time of day information as a proxy for program information. Regardless of which approach is utilized, the result is a profile consisting of "raw probability scores" that can be used as the basis for making recommendations by any grouping algorithm or data mining technique known in the art.

In accordance with one practice of the invention, the basic rule for updating a raw probability score is as follows—

Raw probability score=((raw probability score*viewing weight)+score for current viewing)/(viewing weight+current viewing weight)

—where viewing weight is same as duration, except in cases explained below. Raw probability score is always between 0 and 1 and the sum of the scores in the user profile will add up to 1.

Channel Change:

If the viewing events following a channel change are all short (for example, less than about 2 minutes each) and they match the surfing history, then the viewer is assumed to be surfing during a commercial break and will return to the current program. If the surfing does not match the surfing history, then the system assumes that the viewer is seeking new programming. In either case, the system does not render a final conclusion, in terms of changing the viewer's profile, until the viewer has settled on a new program or returned to the old program. The difference is significant, however, for implementations of the invention that can proactively make recommendations to the user whenever it detects that the user is looking for new programming.

If the channel change occurs just after the program has ended (<3 minutes) then it can be assumed that the user is seeking new programming. No conclusion will be made about whether the user is interested in the program that would have followed the program they just watched had they stayed on the same channel. The reasoning for this is that it is unclear that the user would even be aware of what the new program would be. However, if the user stays on the same channel for more than 3 minutes after the "old" or previous program has ended, and then changes the channel, the system concludes that the user does not like the new program.

If using an approach that employs station information, the system can calculate station scores as it would program scores, as in the description below (and in FIG. 2):

If duration<5 seconds, then:

Do nothing

Add to surf history

Station score=station score+current viewing duration

If duration<2 minutes, then:

Deduct from program score if not part of surf history

If current station is not one of the stations on the surf history then

Program score=((program score*program viewing duration)−current viewing duration)/(program viewing duration−current viewing duration)

Add to surf history

If duration<10 minutes, then:

Add to genre score

Genre score=((genre score*genre viewing duration)+current viewing duration)/(genre viewing duration+current viewing duration)

Add half to program score if program score is >threshold (30 minutes)

Program score=((program score*program viewing duration)+(0.5*current viewing duration)/(total viewing duration+(0.5*current viewing duration))

If duration>10 minutes, then:

Add to genre score

Add to program score

Program score=((program score*program viewing duration)+current viewing duration)/(program viewing duration+current viewing duration)

Figure 2:
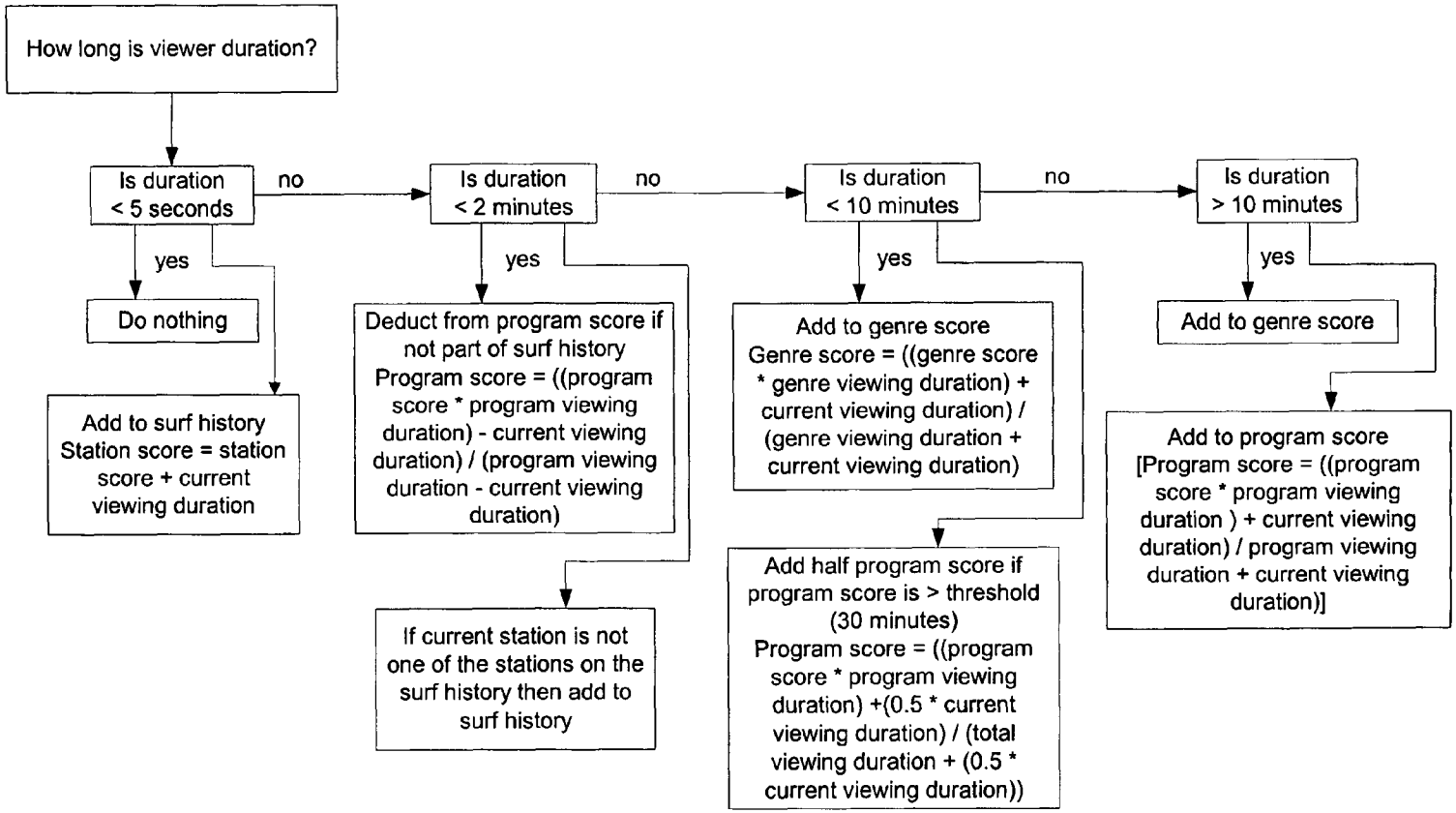
FIG. 2 is a flowchart relating to channel change events.

The numerical values shown in FIG. 2 are based on a 30-minute program length, except for the 2-minute length, which is the minimum amount of time needed to obtain a reasonable idea of what the program is, and to ensure that the user has actually seen part of the program and has not merely been watching 2 minutes of commercial advertisements. Ideally, if the duration of the program being viewed is known, the system can utilize percentage of program viewed (33%, in this example) instead of minutes (10).

It will be noted that a distinction is made here between the user having interest in the program and having interest in the genre or type of program. This is significant for at least two reasons: (1) it recognizes the fact that short viewing durations are not always indicative of complete disinterest; and (2) it employs the concept of genres because genre information is one of the few pieces of programming information that is widely available and thus convenient for use in profiling the user's interests.

As indicated above, due to space constraints in the STB, it may not be practical to store a profile containing all of the programs the user has watched. In that case, the system can employ genre and station information as the basis of the profile. In particular, there may well be thousands of programs, but only a few hundred channels and genres. Furthermore, the average viewer only tends to watch 15 channels and about 20 genres, enabling compact profiles of approximately 35 floating point numbers per each user, as opposed to hundreds or thousands. In one practice of the invention, the genre profile can be calculated as noted above and the station profile can be calculated using the same rules for the program profile.

Examples of Profiles:

The following TABLE 3 shows an example of a profile.

TABLE 3

| Program | Score | Viewing Duration in minutes |
|---|---|---|
| 7 Nightly News | .6 | 90 |
| Seinfeld | .2 | 30 |
| Friends | .2 | 30 |

As shown in TABLE 3, the total viewing duration for the user is 150 minutes. Suppose, for example, there is a viewing event in which the user watches Seinfeld for 20 minutes. The system then adds the 20 minutes to the viewing duration for Seinfeld and recalculate the scores. The score of Seinfeld increases and the other scores decrease, as shown in TABLE 4:

TABLE 4

| Program | Score | Viewing Duration in minutes |
|---|---|---|
| 7 Nightly News | .53 | 90 |
| Seinfeld | .29 | 50 |
| Friends | .18 | 30 |

In the following example (TABLE 5) the viewer watches 8 minutes of Friends. In accordance with one practice of the invention, viewing events of small duration (2-10 minutes) are weighted by a factor of 0.5, so 4 minutes are added to the viewing duration of Friends and the scores are recalculated, resulting in the values shown in TABLE 5:

TABLE 5

| Program | Score | Viewing Duration in minutes |
|---|---|---|
| 7 Nightly News | .52 | 90 |
| Seinfeld | .29 | 50 |
| Friends | .19 | 34 |

In the final example (TABLE 6), the viewer watches 1 minute of Seinfeld. In this practice of the invention, events having a duration of less than two minutes are considered negative events, and the scores are lowered by subtracting the viewing duration from the total for the program, and recalculating the scores. This is only done if the program is not a part of the surf history. For purposes of this example, it is posited that Seinfeld is not a part of the surf history, despite its 50 minutes of viewing duration. The result is that the score for Seinfeld decreases and the other scores increase, as shown in TABLE 6:

TABLE 6

| Program | Score | Viewing Duration in minutes |
|---|---|---|
| 7 Nightly News | .52 | 90 |
| Seinfeld | .28 | 49 |
| Friends | .20 | 34 |

The idea of weighting the viewing duration and recalculating the scores has several benefits. For example, the profiles remain normalized (i.e. the sum of all scores sums to 1). Programs that do not get watched decay to zero. Shows that are "clicked over" (watched very briefly) decay more quickly than shows that were not watched at all. Shows that are partially watched increase moderately; and shows that are watched completely increase more quickly.

Menu/Info:

In addition to channel change events, a system in accordance with the invention can also update the profiles based on menu events, as follows:

Menu arrows: user not interested in current highlighted selection

Program score=((program score*program viewing duration)−1)/(program viewing duration−1)

Menu+Info or Menu+long pause: user is interested in current program genre

Genre score=((genre score*genre viewing duration)+2)/(genre viewing duration+2)

Menu+Select or Info: user is interested in current program

Program score=((program score*program viewing duration)+2)/(program viewing duration+2)

Zero score

V. CONCLUSION

Many variations of the methods and systems of the present invention can be utilized. Such variations may include (but are not limited to), methods of feeding into other algorithms, and utilizing station and genre information instead of program information.

It will be appreciated that still other variations are possible, and that the foregoing embodiments and practices of the invention are set forth by way of example only, and not by way of limitation of the invention, the scope of which is limited only by the following claims.

We claim:

1. A method for generating a viewing recommendation comprising:

parsing dynamically, in accordance with a set of stored processing rules, a stream of command signals to determine which command signals are associated with a user activated control unit and which command signals are associated with a personal video recorder operation;

generating, using at least command signals determined to be associated with a user activated control unit and not using those command signals determined to be associated with a personal video recorder operation, information representative of the viewer's viewing behavior;

updating dynamically a viewer profile of the viewer based on the generated information representative of the viewer's viewing behavior; and determining, based on the viewer profile, at least one viewing recommendation, wherein a command signal is determined to be associated with a personal video recorder operation by determining whether the command signal immediately follows two consecutive command signals determined to be associated with a user activated control unit.

2. The method of claim 1, wherein a command signal indicative of viewing a television program for substantially an exact scheduled time is deemed to be associated with a personal video recorder operation.

3. The method of claim 1, wherein a command signal indicative of a power event is not a command signal associated with a user activated control unit.

4. The method of claim 1, wherein the viewer profile comprises a surfing history of the viewer.

5. The method of claim 4, wherein the surfing history comprises:

no more than a pre-defined number of surfing channels, each surfing channel having a corresponding total duration value, and wherein a pre-determined number of the pre-defined number of surfing channels are designated as top surfing channels.

6. The method of claim 5, wherein the top surfing channels are the channels having the longest total duration value, the corresponding total duration value for each surfing channel is being calculated by combining viewer's viewing time of the each surfing channel during a pre-defined period of time.

7. The method of claim 6, wherein a surfing channel having the total duration value below a pre-defined threshold is removed from the surfing history.

8. The method of claim 7, wherein the parsing further comprises:

determining, according to the set of stored processing rules, a viewing event; and if a duration of the viewing event is below a pre-defined surfing threshold, adjusting the total duration value of a surfing channel in the surfing history, wherein the surfing channel is a channel of the viewing event.

9. The method of claim 1, wherein the parsing further comprises:

determining at least one viewing event according to the set of stored processing rules.

10. The method of claim 9, wherein the viewer profile comprises:

a program probability score corresponding to the at least one viewing event and a sum of all the program scores stored in the viewer profile equals 1.

11. The method of claim 9, wherein updating the viewer profile, comprising at least a first program probability score and a second probability score, further comprises:

adjusting the first program probability score based on a current viewing weight of correlating viewing event; and adjusting at least the second program probability score so a sum of all program probability scores stored in the viewer profile equals 1.

12. The method of claim 9, wherein the viewer profile comprises:

at least one genre probability score corresponding to the at least one the viewing event and a sum of all the genre scores stored in the viewer profiles equals 1.

13. The method of claim 12, wherein updating the viewer profile comprising at least a first genre probability score and a second genre probability score, the method further comprising:

adjusting the first genre probability score based on a current viewing weight of correlating viewing event; and adjusting at least the second genre probability score so a sum of all program probability scores stored in the viewer profile equals 1.

14. The method of claim 9, wherein updating the viewer profile further comprises:

deleting data about the at least one viewing event from a television viewing personalization system.

15. The method of claim 1, wherein updating the viewer profile further comprises:

deleting data about the parsed stream of command signals from a television viewing personalization system.

16. The method of claim 1, wherein a command signal indicative of viewing a television program is deemed to be associated with a user activated control unit if the command signal indicative of viewing a television program is followed by another command signal within a pre-defined time period.

17. A non-transitory computer-readable medium storing computer-executable instructions that when executed cause a television viewing personalization system to perform steps, comprising:

parsing, in accordance with a set of stored processing rules, a stream of command signals to determine which command signals are associated with a user activated control unit and which command signals are associated with a personal video recorder operation and to generate, using at least command signals associated with a user activated control unit, information representative of the viewer's viewing behavior;

disregarding those command signals determined to be associated with a personal video recorder operation; and dynamically determining at least one viewing recommendation based on the generated information, wherein a command signal is determined to be associated with a personal video recorder operation by determining whether the command signal immediately follows two consecutive command signals determined to be associated with a user activated control unit.

18. The computer-readable medium of claim 17, wherein a command signal indicative of a power event is not a command signal associated with a user activated control unit.

19. The computer-readable medium of claim 17, wherein a command signal indicative of viewing a television program is deemed to be associated with a user activated control unit if the command signal indicative of viewing a television program is followed by another command signal within a predefined time period.

* * * * *